US009816705B2

(12) United States Patent
Martin et al.

(10) Patent No.: US 9,816,705 B2
(45) Date of Patent: Nov. 14, 2017

(54) FLARE BURNER FOR A COMBUSTIBLE GAS

(71) Applicant: Honeywell International Inc., Morristown, NJ (US)

(72) Inventors: Matthew Martin, Tulsa, OK (US); Stefano Bietto, Tulsa, OK (US); Kurt Kraus, Tulsa, OK (US); Dusty Ray Richmond, Cleveland, OK (US)

(73) Assignee: Honeywell International Inc., Morris Plains, NJ (US)

( * ) Notice: Subject to any disclaimer, the term of this patent is extended or adjusted under 35 U.S.C. 154(b) by 249 days.

(21) Appl. No.: 14/546,531

(22) Filed: Nov. 18, 2014

(65) Prior Publication Data

US 2016/0138805 A1 May 19, 2016

(51) Int. Cl.
*F23G 7/08* (2006.01)
*F23D 14/04* (2006.01)

(52) U.S. Cl.
CPC ..... *F23G 7/085* (2013.01); *F23D 14/045* (2013.01); *F23G 2209/14* (2013.01)

(58) Field of Classification Search
CPC ..... F23G 7/085; F23G 2209/14; F23D 14/045
USPC ..... 431/202, 176, 350, 352, 353, 354, 356; 126/41 R, 39 R, 110 C, 116 R
See application file for complete search history.

(56) References Cited

U.S. PATENT DOCUMENTS 1,621,092 A * 3/1927 Toffteen ..... F23D 11/08 239/214.15
3,822,985 A 7/1974 Straitz, III
3,995,986 A 12/1976 Straitz, III
4,098,566 A * 7/1978 Zink ..... F23L 7/005 431/202
4,548,577 A 10/1985 McGill
4,652,232 A 3/1987 Schwartz et al.
5,649,820 A 7/1997 Keller et al.
5,681,160 A 10/1997 Ellis et al.
5,846,068 A 12/1998 Schwartz et al.
5,865,613 A 2/1999 Rajewski
(Continued)

FOREIGN PATENT DOCUMENTS

CA 2236224 A1 10/1999
CN 102901098 A 1/2013
CN 202884924 U 4/2013
CN 103486588 A 1/2014
EP 1906089 A2 4/2008
(Continued)

OTHER PUBLICATIONS

Liu et al. "Pollution reduction from flares by swirl vanes in a cross-flow," International Journal of Environment and Pollution (2007), 31(1-2), 193-209.
(Continued)

*Primary Examiner* — Avinash Savani
*Assistant Examiner* — Rabeeul Zuberi

(57) ABSTRACT

A flare burner for burning combustible waste gases with a manifold, a plurality of arms, and a plurality of outlets disposed on the plurality of arms. The arms may be perpendicular to the manifold. The arms may also extend outwardly from the manifold. The arms may extend into annuli, to produce oppositely flowing exit gas. A curved dispersing surface may be disposed above the manifold. The arms may comprise a curvilinear shape, or include both a linear and a curvilinear portion. The outlets are configured and spaced such that flame is short relative to size of the flare burner.

2 Claims, 12 Drawing Sheets

(56) References Cited

U.S. PATENT DOCUMENTS

| | | | | |
|---|---|---|---|---|
| 5,975,885 | A | 11/1999 | Rajewski | |
| 6,485,292 | B1 | 11/2002 | Rhodes et al. | |
| 7,247,016 | B2 | 7/2007 | Mashhour | |
| 7,789,659 | B2 * | 9/2010 | Godon | F23C 6/047 431/202 |
| 7,914,282 | B2 | 3/2011 | Al-Hasan et al. | |
| 8,096,803 | B2 | 1/2012 | Mashhour et al. | |
| D684,682 | S | 6/2013 | Kovash et al. | |
| 8,568,134 | B2 | 10/2013 | Poe et al. | |
| 2003/0059732 | A1 | 3/2003 | Coffey et al. | |
| 2006/0105276 | A1 | 5/2006 | Wilkins et al. | |
| 2007/0224564 | A1 * | 9/2007 | Hong | F23L 7/005 431/202 |
| 2008/0081304 | A1 | 4/2008 | Poe et al. | |
| 2010/0291492 | A1 | 11/2010 | Poe et al. | |
| 2011/0207066 | A1 | 8/2011 | Hong et al. | |
| 2012/0039018 | A1 | 2/2012 | Diesselhorst et al. | |
| 2012/0231399 | A1 | 9/2012 | Beck et al. | |
| 2014/0147795 | A1 | 5/2014 | Tremblay et al. | |

FOREIGN PATENT DOCUMENTS

| | | | |
|---|---|---|---|
| EP | 1979677 | B1 | 10/2012 |
| JP | 3924264 | B2 | 6/2007 |
| JP | 5473364 | B2 | 4/2014 |

OTHER PUBLICATIONS

Cupp, Robert, "New Flare Technology Utilizing Low Pressure Steam," National Petrochemical & Refiners Association Annual Meeting (2010), vol. 1, 437-445.

* cited by examiner

FLARE BURNER FOR A COMBUSTIBLE GAS

FIELD OF THE INVENTION

The disclosure relates generally to a flare burner for the burning and disposal of combustible waste gases and more particularly, to a flare burner which increases the mixing of the combustible waste gases and oxygen from the surrounding air.

BACKGROUND OF THE INVENTION

Gas flares are commonly located at production facilities, refineries, processing plants, and the like for disposing of combustible waste gases and other combustible gas streams that are diverted due to venting requirements, shut-downs, upsets, and/or emergencies. Such flares are often operated in a smokeless or near smokeless manner, which can be largely achieved by making sure that the flammable gas to be discharged and burned ("flare gas") is admixed with enough air to sufficiently oxidize the gas.

A typical flare apparatus includes one or more flare burners and a pilot. As gases exit the flare burners, the gases mix with the oxygen and combust (via the flame from the pilot). Some flare burners use various methods in an attempt to provide sufficient oxygen in a combustion zone of a flare burner to help minimize the formation of smoke.

For example, in some flare burners, the size of the flare burner is larger. However, as a result of the large size of the flare burner, a significant amount of ground space is often required for the flare burner. This problem is increased when multiple flare burners are used, with the burner array requiring a large area of ground space.

In some flare burners, the flame that is produced is very high. Not only is the high flame height undesirable, but the high flame height requires a higher fence around the flare burner area. The higher fence is more expensive. The higher flow of waste gas in the center of the flare tip can also increase the oxygen requirements at the center of the flare tip. This can increase the propensity of the flare to smoke.

Furthermore, many large flare burner areas require a large amount of piping and multiple valves. The required piping and valves increase the capital cost associated with the flare burner. Additionally, these types of flare burners also may require welded joints and attachment points. This results in a flare burner that is complex to assemble and costs more.

Finally, many flare burners are noisy mainly due to both jet noise and combustion noise. While the jet noise (the noise associated with the speed of the gases exiting the burner) may not be able to be lowered, it is believed that the combustion noise (associated with the mixing of the air and fuel gases) can be lowered and still provide an acceptable flame.

Therefore, it would be desirable to have a flare burner for combustible gas that addresses at least one of these issues.

SUMMARY OF THE INVENTION

Various designs for flare burners for combustible gases have been invented to provide an effective flare burner that can provide increased mixing between the surrounding air and the combustible gas, without some of the drawbacks discussed above.

In one aspect of the present invention, the invention may be characterized as a flare burner for burning combustible waste gases. The burner comprises a manifold comprising an inlet, a plurality of arms, and a plurality of outlets. The inlet is configured to be secured to a conduit for combustible waste gases. The plurality of outlets are disposed on a plurality of arms such that oxygen may mix with combustible waste gases exiting the outlets.

In at least one embodiments of the present invention, the manifold of the flare burner comprises a body extending in a first direction having a longitudinal axis parallel thereto. The arms from the plurality of arms each have a longitudinal axis extending along a length of a body, and the longitudinal axes of the body are relatively perpendicular to the longitudinal axis of the body of the manifold.

In another embodiment, the manifold of the flare burner comprises a body and a curved dispersing surface disposed in a middle of the body of the manifold. The arms from the plurality of arms extend radially outward from the body.

In one or more embodiments of the present invention, the manifold of the flare burner comprises a body. A first annulus surrounds the body and a second annulus surrounds the body. The arms from the plurality of arms extend radially outward from the body into the first annulus and the second annulus. It is contemplated that the burner further includes at least one baffle in the first annulus configured to impart a direction of rotation to air within the first annulus and at least one baffle in the second annulus configured to impart a direction of rotation to air within the second annulus. The direction of rotation of gas exiting the first annulus is opposite the direction of rotation of gas exiting the second annulus.

In at least one embodiment of the present invention, the manifold of the flare burner comprises a body. The arms from the plurality of arms extend radially outward from the body. A first end of each arm is disposed adjacent the body of the manifold and a second end of each arm is split into two branched portions. It is contemplated that each branched portion is split into two more branched portions. It is even further contemplated that an outlet is disposed at each end of each branched portion. It is even further contemplated that a collar is surrounding each outlet to provide a swirl to combustion gases exiting therefrom.

In some of the embodiments of the present invention, the manifold comprises a body. The arms from the plurality of arms extend radially outward from the body and each arm includes a first portion without an apertures and a second portion with one or more apertures. It is contemplated that at least the second portion has a curvilinear shape and the first portion and the second portion have approximately the same length. It is contemplated that the arms extend upwardly away from the body of the manifold. It is also contemplated that the arms extend downwardly away from the body of the manifold. It is still further contemplated that each arm has a cross-sectional shape comprising a top rounded portion and a tail portion comprising two intersecting linear edges.

In one or more embodiments of the present invention, each arm includes a plurality of outlets and the outlets on each arm are disposed such that a distance between the manifold and an outlet closest to the manifold on that arm is greater than a distance between any two outlets on that arm.

In some embodiments of the present invention, each arm includes a plurality of outlets and the outlets on each arm are disposed about a circumference of a circle. A distance between the manifold and an outlet closest to the manifold on that arm is greater than a radius of the circle. It is contemplated that the outlets on each arm are spaced at least 11° from adjacent outlets.

In various embodiments of the present invention, each arm includes a plurality of outlets with a width being the distance between two furthest apart outlets on that arm and the width is smaller than a distance between the outlets on that arm and outlets on adjacent arm.

In at least one embodiment of the present invention, each arm includes a plurality of outlets, and the outlets on each arm are separated from adjacent outlets by a wall having a height between one to five times a diameter of the outlets. It is contemplated that the outlets of each arm are disposed on a portion of an arm that has a cross-sectional shape comprising a top rounded portion and a tail portion comprising two intersecting linear edges.

In some embodiments of the present invention, each arm includes an inlet and the inlets are disposed within the manifold and the inlets of the arms intersect.

Additional objects, embodiments, and details of the invention are set forth in the following detailed description of the invention.

DETAILED DESCRIPTION OF THE DRAWINGS

The attached figures will make it possible to understand the various embodiments of the present invention can be produced. In these figures, identical reference numbers denote similar elements.

DETAILED DESCRIPTION OF THE INVENTION

Various new flare burners have been invented which provide for improved gas flow. The new flare burners distribute the flame on a larger surface and more evenly provide the required combustion air. When the flame receives air more evenly, there is better mixing of the fuel and the air and a minimization of fuel rich zones which can generate smoke. Additionally, when the flame is distributed on a larger surface the flame is shorter compared to a traditional system with the same output. Consequently, the output will be greater compared to a system with the same maximum flame length. Furthermore, the footprint area of the whole flare array is smaller compared to a system with the same output and same max flame length. These and other benefits will be appreciated based upon the following detailed description.

With reference to the attached drawings, one or more embodiments of the present invention will now be described with the understanding that the described embodiments are merely preferred and are not intended to be limiting. It is contemplated that the flare burners of the present invention can be used in other flame burning applications beyond a flare array and may simply be used as a single flare burner for simply disposing or combusting unwanted gas.

Figure 1:
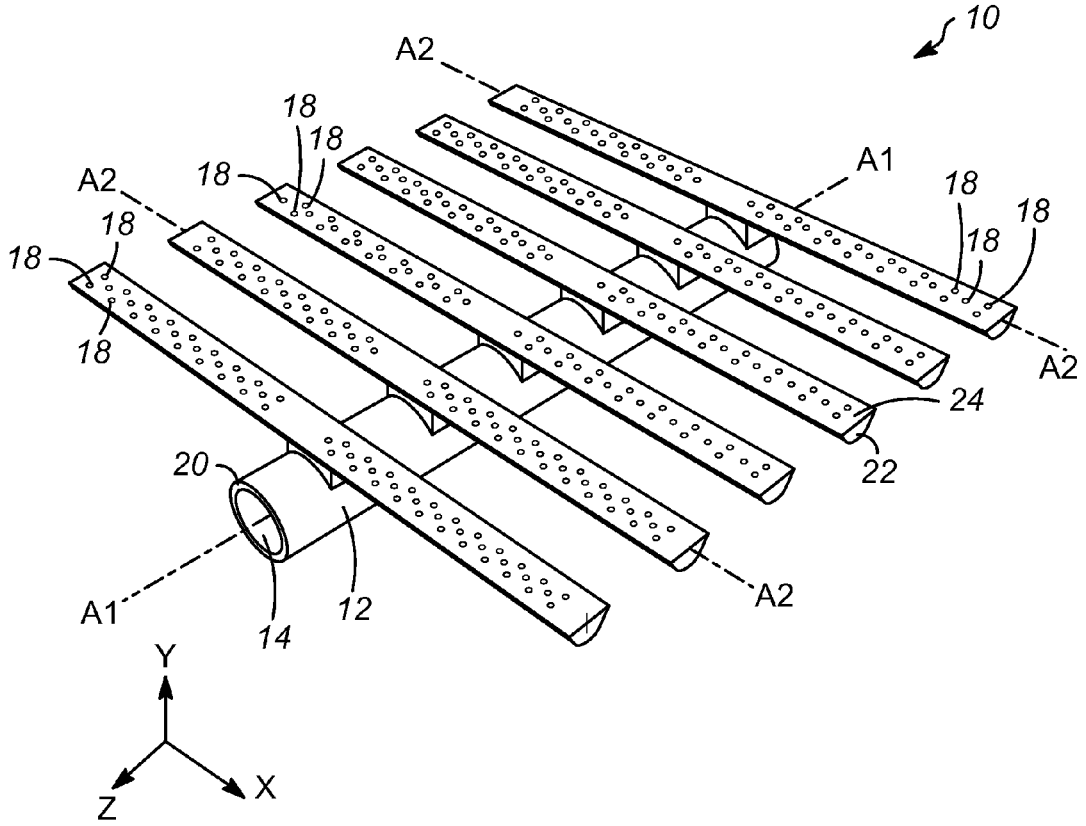
FIG. 1 shows a top and side perspective view of a flare burner according to one embodiment of the present invention.

As shown in FIG. 1, in a first embodiment, a flare burner 10 according to the present invention comprises a manifold 12 with an inlet 14 and a plurality of arms 16. The inlet 14 is configured to be secured to a conduit (not shown) for combustible waste gases. Disposed on each of the arms 16 of the plurality of arms 16 are a plurality of outlets 18.

As shown in FIG. 1, the manifold 12 comprises a tubular body 20 with a longitudinal axis $A_1$. The tubular body 20 may be made from stainless steel. The arms 16 comprise elongate members each having a longitudinal axis $A_2$. Preferably, the axes $A_2$ of the arms 16 are all relatively parallel to each other. In a most preferred embodiment, the longitudinal axes $A_2$ of the arms 16 are also generally perpendicular to the longitudinal axis $A_1$ of the body 20. In a preferred design, when viewed along the longitudinal axis $A_2$, an arm 16 has a lower surface 22 or bottom surface that is curved or semi-circular, and an upper surface 24 or top surface that is planar.

The outlets 18 are preferably disposed on the upper surface 24 of the arm 16 and can be drilled or cast. The size of the outlets 18 (preferably between 1/16 inch and 1/4 inch) as well as the location of the outlets 18, can be optimized according to the application. The length of the arms 16 should be so that most of the area of the flare burner 10 is evenly spaced enough between the outlets 18 to allow sufficient entrainment of the surrounding air with combustible gas exiting via the outlets 18. It is believed that an appropriate spacing between adjacent outlets 18 is approximately three times the size (or area) of the outlet 18.

Figure 2A:
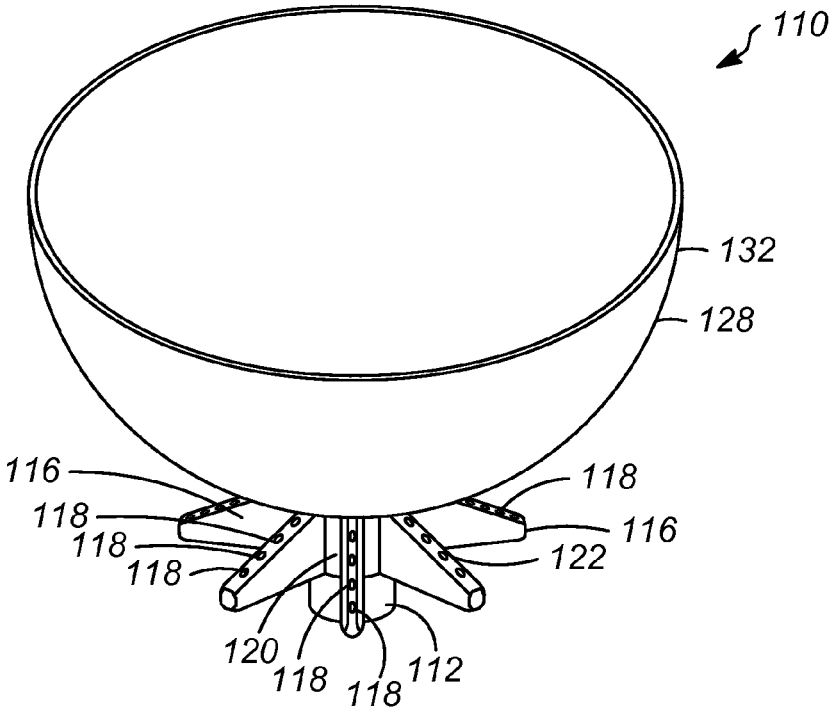
FIG. 2A shows a top and side perspective view of a flare burner according to another embodiment of the present invention.
Figure 2B:
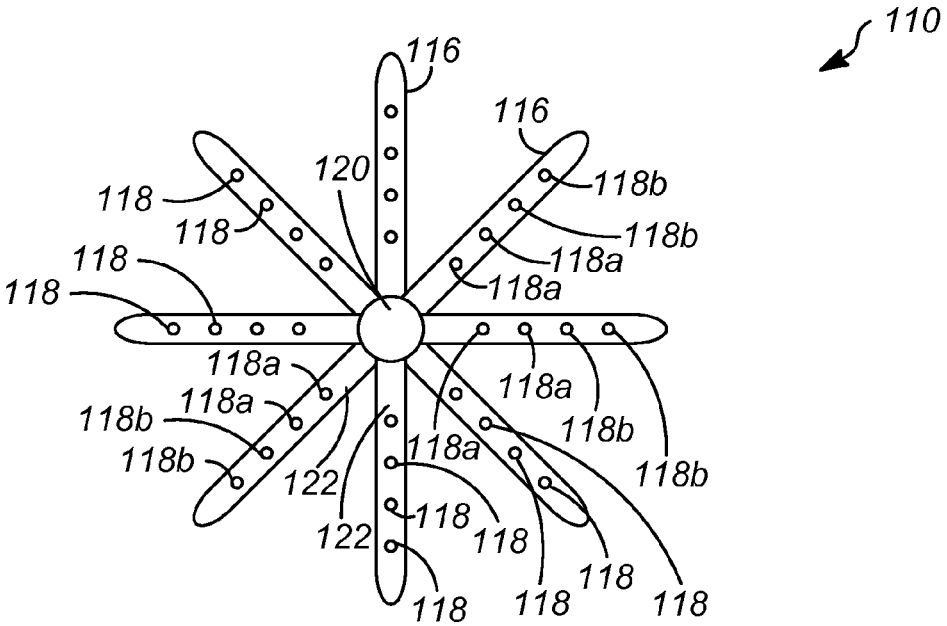
FIG. 2B shows a top view of a portion of the flare burner of FIG. 2A.

Turing to FIGS. 2A and 2B, in another embodiment of the present invention, a flare burner 110 includes the arms 116 that all extend radially outwardly from the body 120 of the manifold 112. Disposed on a top 126 of the manifold 112, preferably in the middle, is a curved dispersing surface 128. Although depicted with the arms 116 angled downward, other configurations may be used.

As shown in FIG. 2B, the outlets 118 are disposed on the upper surfaces 22 of the arms 116 of the flare burner 110 such that a first plurality of outlets 118*a* is disposed proximate the body 120 of the manifold 112. At least a second plurality of outlets 118*b* are disposed further from the body 120 of the manifold 112 than the first plurality of outlets 118*a*. For example, the different plurality of outlets 118 may be arranged on concentric circles, with each arm 116 including, for example, eight outlets 118. Other designs are also contemplated.

The first plurality of outlets 118*a* (closest to the body 120 of the manifold 112) is used to establish flow along a surface 132 of the curved dispersing surface 128. This will aerodynamically spread the flow of combustible gas and entrain more of the surrounding air therewith. The second plurality of outlets 118*b* (further from the body 120 of the manifold 112) are disposed to allow the combustible gas to impinge the surface 132 of the curved dispersing surface 128 in a delayed manner. This will allow the combustible gas from the second plurality of outlets 118*b* to entrain more of the surrounding air before impinging on the surface 132 of the curved dispersing surface 128. This partially-premixed gas mixture then flows along the surface 132 of the curved dispersing surface 128. Due to the jet expansion that occurs in a direction away from the curvature of the surface 132, a higher velocity of the mixture is maintained delaying the onset of combustion while a greater portion of air is entrained into the gas flow.

Figure 3A:
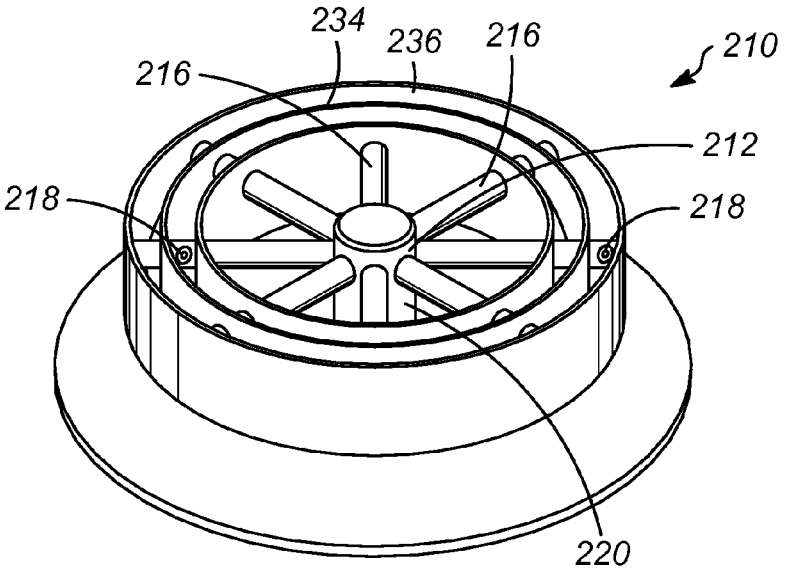
FIG. 3A shows a top and side perspective view of a flare burner according to another embodiment of the present invention.
Figure 3B:
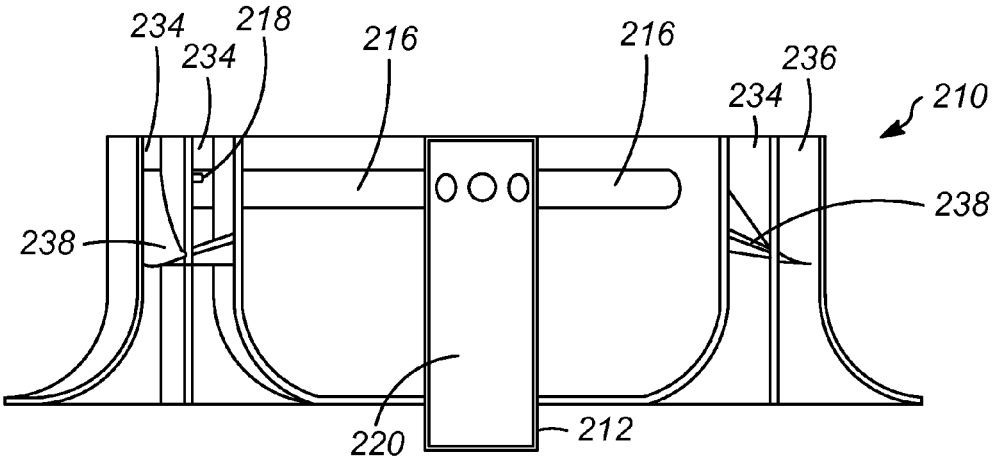
FIG. 3B shows a side cutaway view of the flare burner of FIG. 3A.

With reference to FIGS. 3A and 3B, another embodiment of the present invention is shown in which a first annulus 234 surrounds the body 220 of the manifold 212 of the flare burner 210. A second annulus 236 surrounds the first annulus 234. The arms 216 of the flare burner 210 extend radially outward from the manifold 212 into at least one of, and preferably both of, the first annulus 234 and the second annulus 236.

Each arm 216 includes at least one outlet 218 disposed in the first annulus 234 or disposed in the second annulus 236. Alternatively, each arm 216 may include at least one outlet 218 in each of the first annulus 234 and the second annulus 236. The outlets 218 may be angled upwards to direct the flow of combustion gases exiting therefrom.

As the combustion gases exit the outlets 218, the combustion gases will flow around through either the first annulus 234 or the second annulus 236. A rotational direction of combustion gas exiting the first annulus 234 is preferably opposite a rotational direction of combustion gas exiting the second annulus 236. For example, in FIG. 3A, the combustion gas in the first annulus 234 will have a counterclockwise rotational direction. Concomitantly, the combustion gas in the second annulus 236 will have a clockwise rotational direction. By having opposite rotational directions, increased mixing between the flare gas and the air is produced.

It is preferred that each annulus 234, 236 includes one or more baffles 238 to further impart a rotational direction to the gas exiting the outlets 218 and ultimately exiting out of the tops of each annulus 234, 236. The baffles 238 also increase the speed of the surrounding air flowing up through the each annulus 234, 236 and mixing with the combustion gas therein. The high pressure gas is used to entrain and partially premix a portion of the surrounding air with the combustible gases exiting the outlets 218. This entrainment is done inside of the first annulus 234 and second annulus 236 in association with the baffles 238.

In current designs, fuel mixing with the air stream is produced by shear mixing with the quiescent air. However, using the fuel to produce a forced-shear zone between the first annulus 234 and second annulus 236 is believed to enhance mixing between the fuel and the air. It is preferred that the opposite-direction momentum is destroyed, for example, with turbulence. A proper balance between the first annulus 234 and second annulus 236 should produce a net-zero spin. After the rotational component of the mixture is reduced, the upward component of the gas flow momentum should be maintained after mixing. Slight premixing may be by placing the outlets just below the tops of the first annulus 234 and second annulus 236.

Figure 4A:
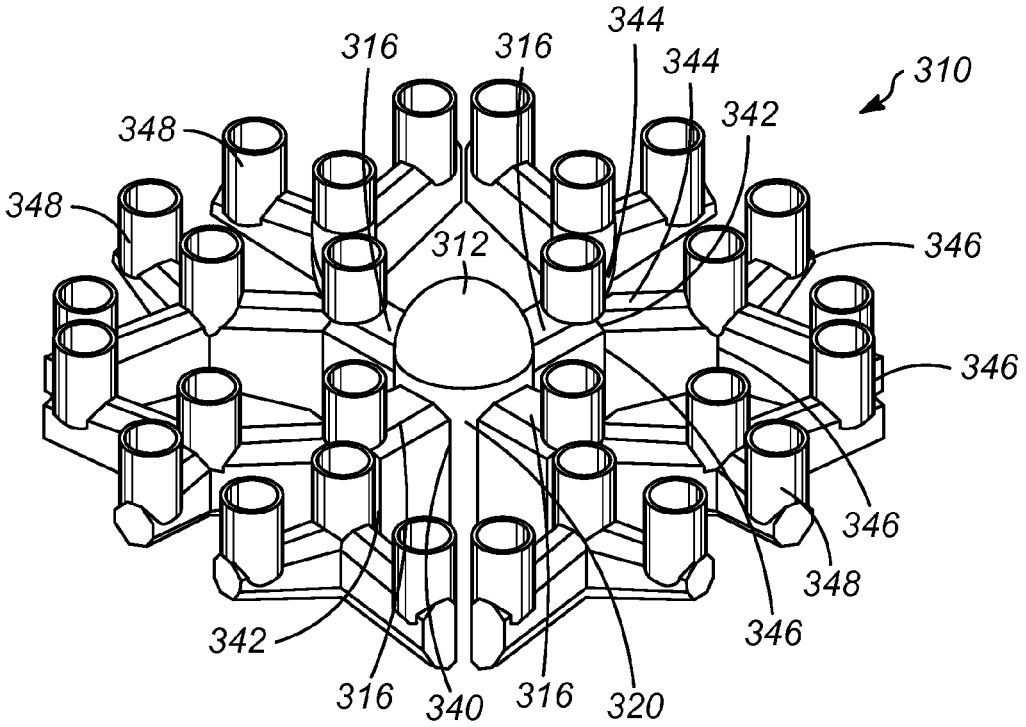
FIG. 4A shows a top and side perspective view of a flare burner according to another embodiment of the present invention.
Figure 4B:
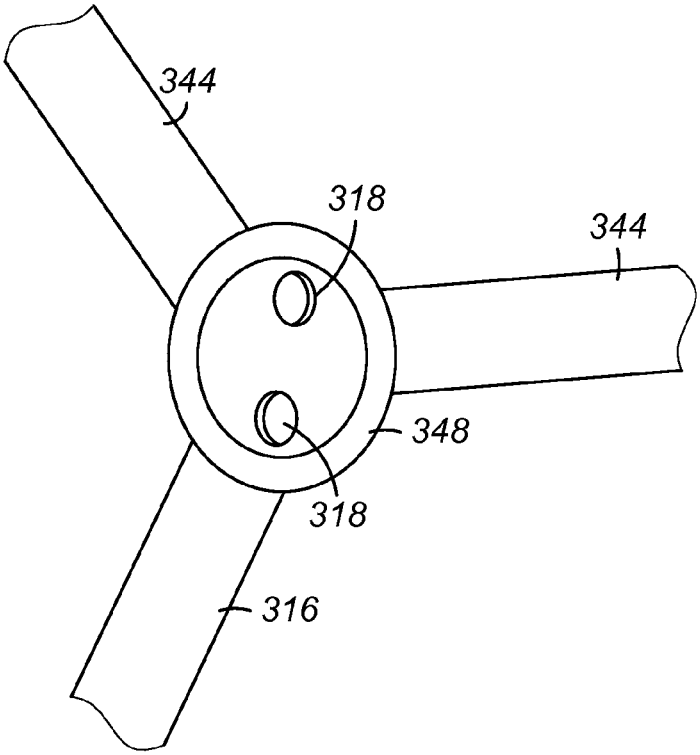
FIG. 4B shows a top view of a portion of the flare burner of FIG. 4A.

In FIGS. 4A and 4B, another embodiment of a flare burner 310 is shown in which the arms 316 extend radially outward from the body 320 of the manifold 312. A first end 340 of each arm 316 is disposed adjacent the body 320 of the manifold 312, and a second end 342 of each arm 316 is split into two branched portions 344. Additionally, each branched portion 344 may be further split into two more branched portions 344. Accordingly, the arms 316 preferably have a "fractal shape" (when viewed from the top).

The outlets 318 are disposed on the branched portions 344 of the arms 316. See, FIG. 4B. In a preferred embodiment, the outlets 318 are disposed at each end 346 of each branched portion 344. The burner 310 is preferably made of a single piece casting which can be drilled with sufficient outlets 318 for the desired flow rate.

It is preferred that the outlets 318 are configured to provide a swirl to combustible gases exiting therefrom. Therefore, as shown in FIG. 4B, a collar 348 preferably surrounds at least two outlets 318. In such a design, it is preferred that the outlets 318 are configured to expel combustible gas in opposite directions. The collar 348 will direct the combustible gas from the outlets 318 to flow in a circular or swirl pattern. As the combustible gas exits out of the collar 348, the combustible gas will continue to swirl. The swirling component of the velocity increases the mixing rate of the combustible gas and the air. It is believed that swirl can change the flame shape such that the height is reduced and the flame is thus, more compact.

Figure 5:
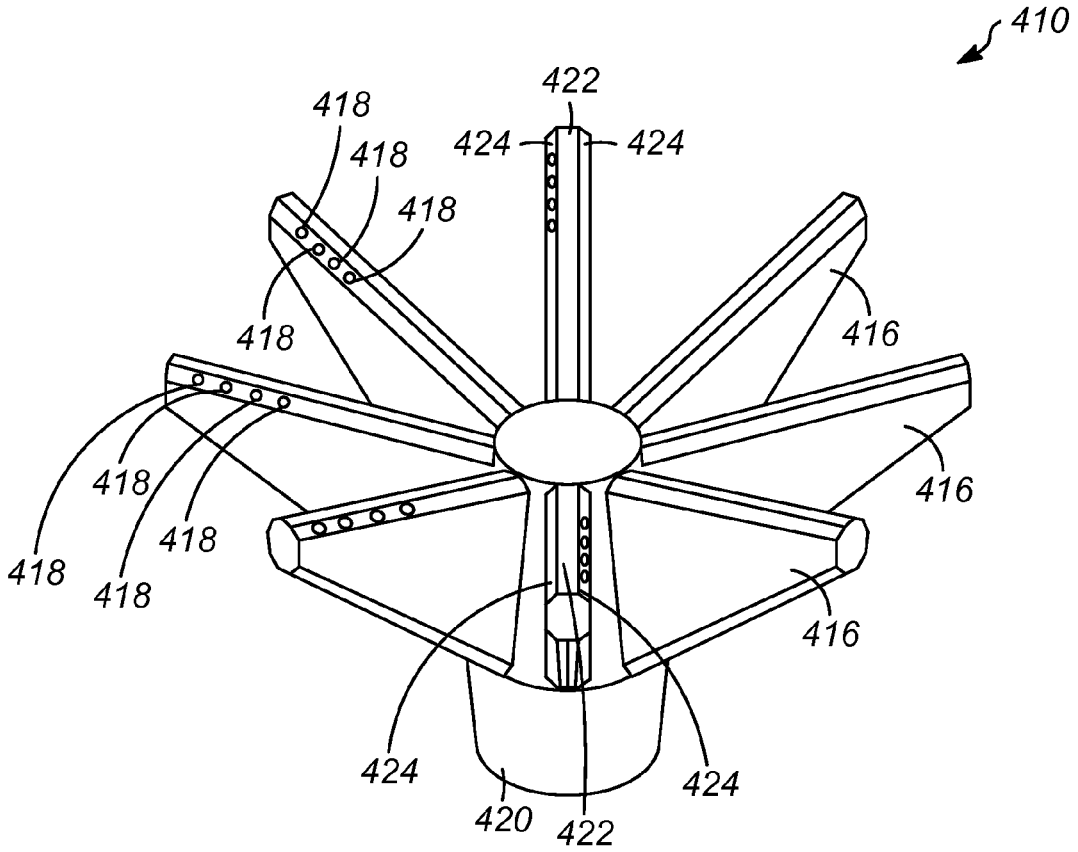
FIG. 5 shows a top and side perspective view of a flare burner according to one embodiment of the present invention.

Turning to FIG. 5, another embodiment according to the present invention is shown in which a flare burner 410 comprises a plurality of arms 416 extend radially outward from the body 420 of the manifold 412. Each arm 416 includes a plurality of outlets 418 disposed along a top surface 422 of each arm 416. A top portion of the arms comprises a planar top surface 422 and two angular surfaces 424, one disposed on each side of the planar surface 422. The outlets are preferably drilled into one of the angular surfaces 424 so as to provide a swirl to the exiting gas. The outlets 418 are disposed among the arms 416 such that the outlets 418 produce a flame that is no more than approximately 1 meter high.

As can be seen, the arms 416 are angled upwards as the arm 416 extends further away from the body 420 of the manifold 412. It is also preferred that the vertical size of the arms 416 is reduced as the arm 416 extends further away from the body 420 of the manifold 412. This flare burner 410 is made from a single piece, and preferably does not include welds.

Figure 6A:
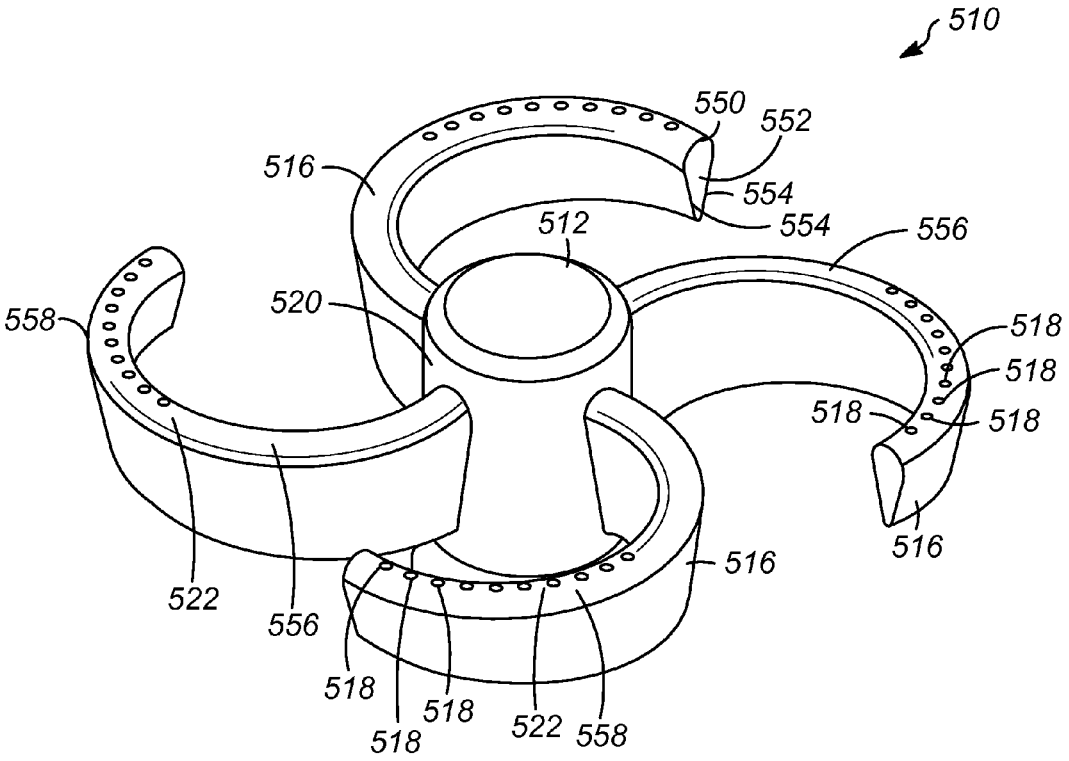
FIG. 6A shows a top and side perspective view of a flare burner according to one embodiment of the present invention.
Figure 6B:
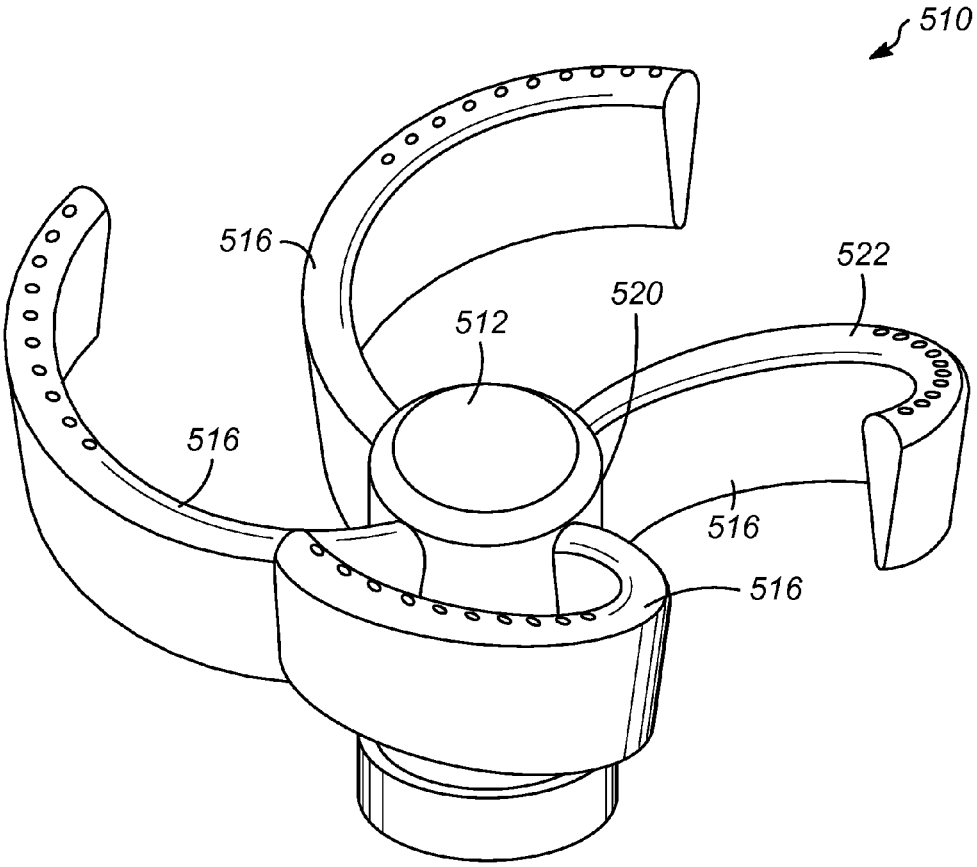
FIG. 6B shows a top and side perspective view of a flare burner according to one embodiment of the present invention.
Figure 6C:
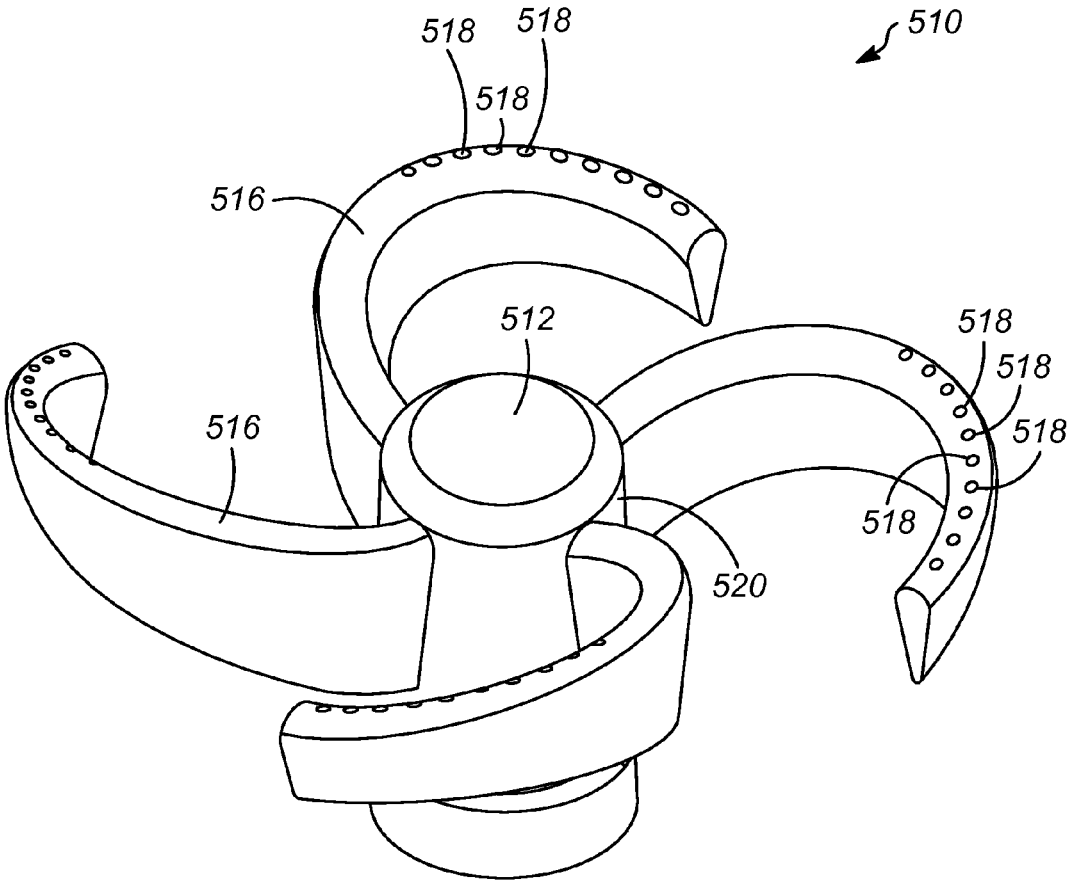
FIG. 6C shows a top and side perspective view of a flare burner according to one embodiment of the present invention.

With reference to FIGS. 6A to 6C, another flare burner 510 is shown in which the arms 516 from the plurality of arms 516 extend radially outward from the body 520 of the manifold 512. Each arm 516 has a curvilinear shape (when viewed from the top).

Additionally, each arm 516 preferably has a cross-sectional shape comprising a top rounded portion 550 and a bottom tail portion 552 comprising two intersecting linear edges 554.

A top surface 522 of each arm 516 includes a plurality of outlets 518. Preferably, the outlets 518 are drilled into the arms 516 of the flare burner 510. Additionally, the outlets 518 can be configured to expel combustible gas generally perpendicular to the ground or at a different angle (acute or obtuse) to the ground.

It is preferred that the top surface 522 of each arm 516 includes a first portion 556 without any outlets 518 and a second portion 558 with one or more outlets 518. The first portion 556 of the top surface 522 and the second portion 558 of the top surface 522 may have approximately the same length. It is contemplated that the first portion 556 without any outlets 518 or the second portion 558 with the outlets 518 are linear.

As shown in FIG. 6B, the arms 516 may extend upwardly away from the body 520 of the manifold 512. More specifically, as shown, the vertical position of the top surfaces 522 of the arms 516 increases over the length of the arm 516. Although not depicted as such, it is contemplated that, the arms 516 extend downwardly away from the body 520 of the manifold 512. More specifically, the vertical position of the top surfaces 522 of the arms 516 decreases over the length of the arm 516.

As shown in FIG. 6A, the outlets 518 on the arms 516 are all coplanar. However, as shown for example in FIG. 6C, it is contemplated that the outlets 118 are angled inwards towards the body 520 of the manifold 512. As also shown the size of the arms 516 decreases as the arm 516 gets further away from the body 520 of the manifold 512. Other configurations are also contemplated, for example with the outlets 518 angled away from the body 520 of the manifold 512 or the outlets 518 having a variety of configurations (some angled inward, some outward, some vertical, etc.).

Figure 7A:
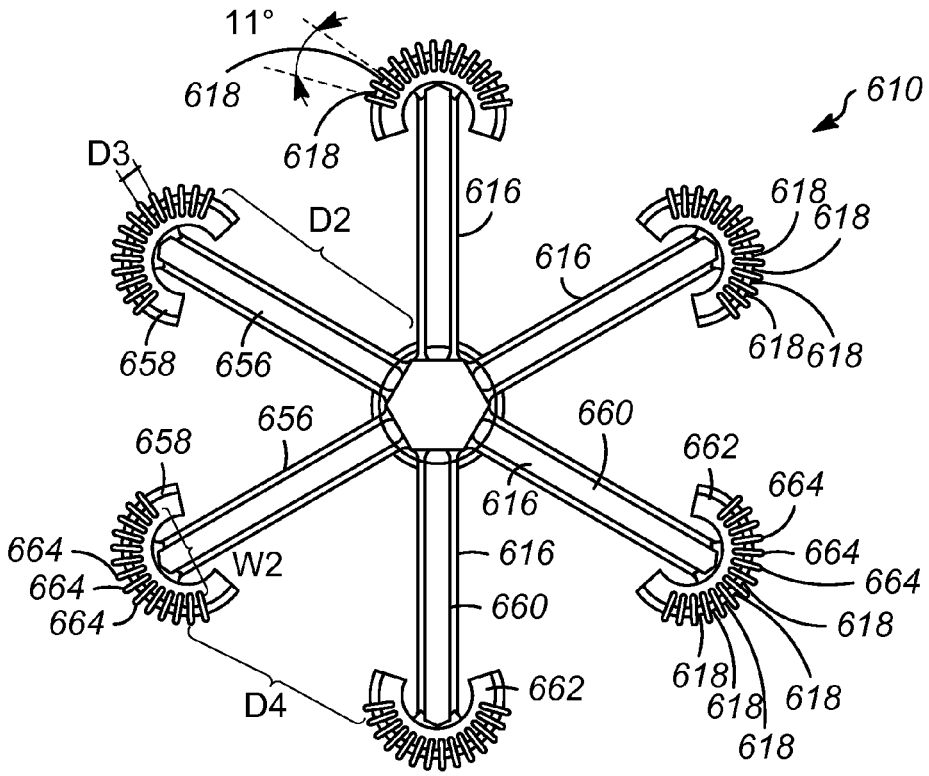
FIG. 7A shows a top view of a flare burner according to one embodiment of the present invention.
Figure 7B:
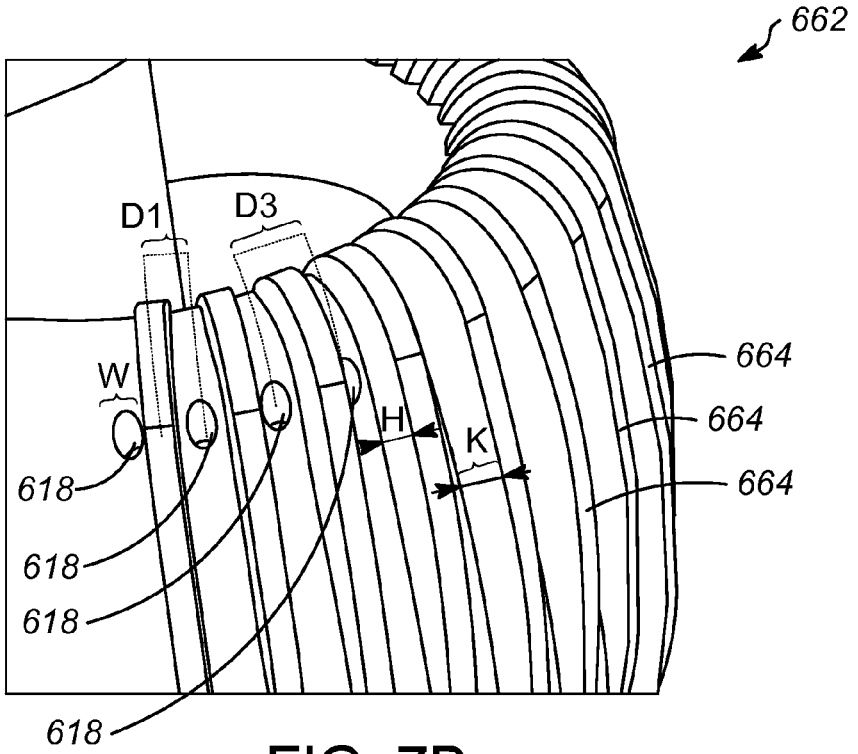
FIG. 7B shows a top and side perspective view of a portion of the flare burner shown in FIG. 7A.
Figure 7C:
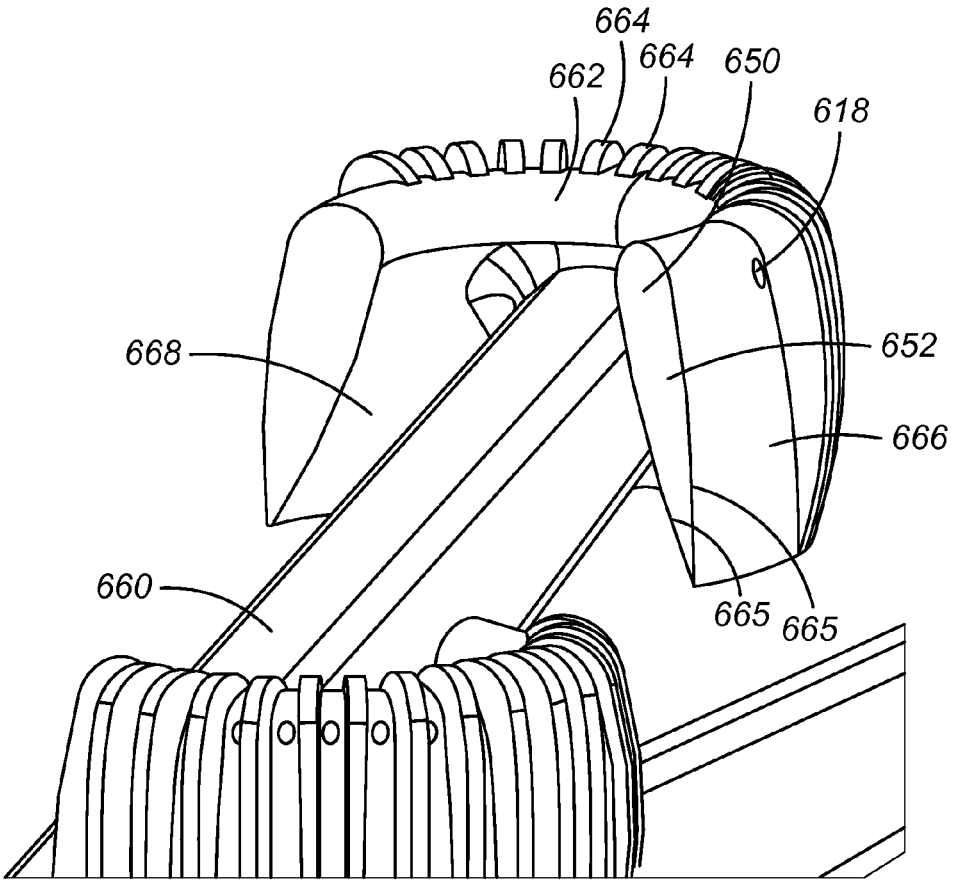
FIG. 7C shows a side view of a portion of the flare burner shown in FIG. 7A.

Turning to FIGS. 7A to 7C, another flare burner 610 according to the present invention is shown. As can been seen in this embodiment, each arm 616 of the burner 610 includes a portion 656 without any outlets 618 and a portion 658 with outlets 618. As depicted, the portion 656 without any outlets 618 comprises a linear portion 660 and the portion with outlets 658 comprises a curvilinear portion 662 (when viewed from the top of the flare burner 610). Preferably, the outlets 618 are disposed approximately about a circumference of a circle. Other configurations are contemplated, for example, the portion 656 of the arm 616 without any outlets 618 may comprise a curvilinear portion, or the portion 658 of the arm 616 with outlets 618 may comprise a linear portion.

As can be seen in FIG. 7B, in this embodiment, the curvilinear portion 662 of the arms 616 includes a plurality of walls 664 separating adjacent outlets 618. Preferably, the walls 664 each have a height H between one to five times greater than a width W of the outlets 618. Additionally, the distance $D_1$ between a center of a wall 664 and a center of an adjacent outlet 618 is between one and four times greater than the width W of that outlet 618. If the outlets 618 comprise circular apertures, as is contemplated for many of the embodiments herein, the width W of the outlets 618 will be a diameter.

Turning to FIG. 7C, in order to improve the flow of surrounding air, the curvilinear portions 662 of the arms 616 may have a cross-sectional shape comprising a top rounded portion 650 and a bottom (or tail) portion 652 comprising two intersecting linear edges 665. This will produce a first flow of air up on outer side 666 of the curvilinear portion 662 to entrain the surrounding air. A second flow of air will be created on an inner side 668 of the curvilinear portion 662 which will mix with the combustible gas and air mixture flowing upward along the outer side 666 of the curvilinear portion 662.

Figure 8A:
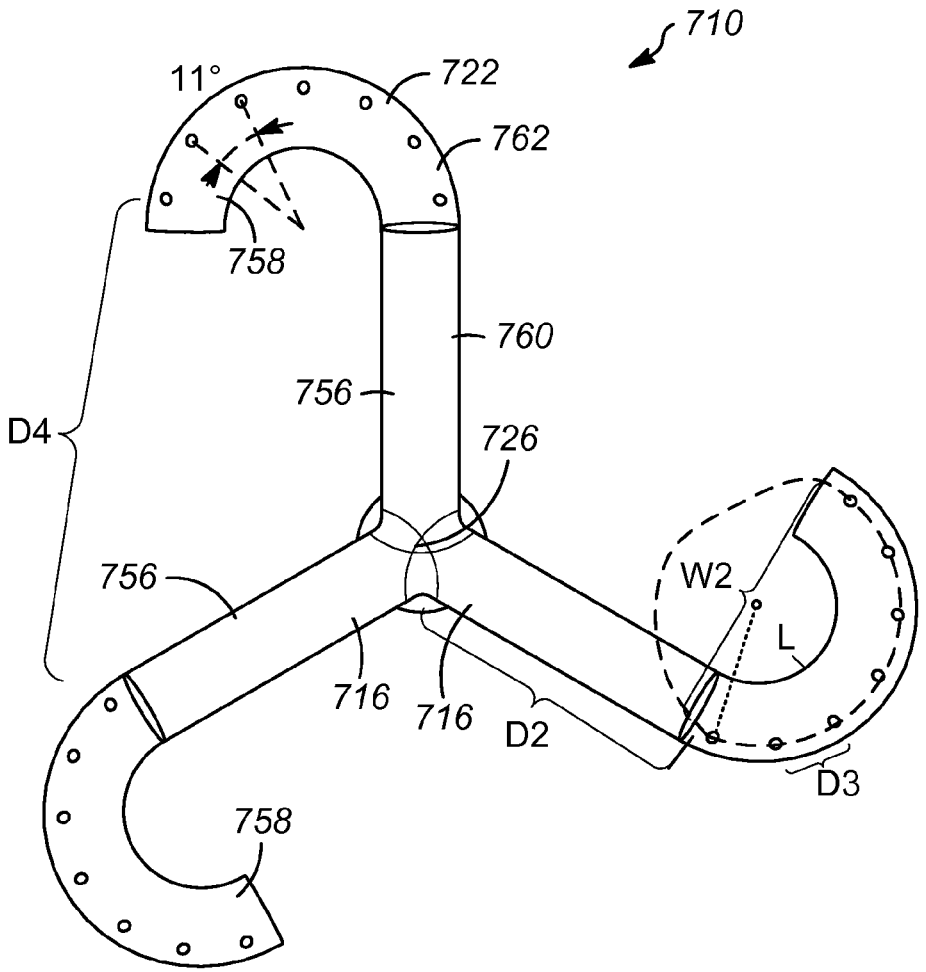
FIG. 8A shows a top view of a flare burner according to one embodiment of the present invention.
Figure 8B:
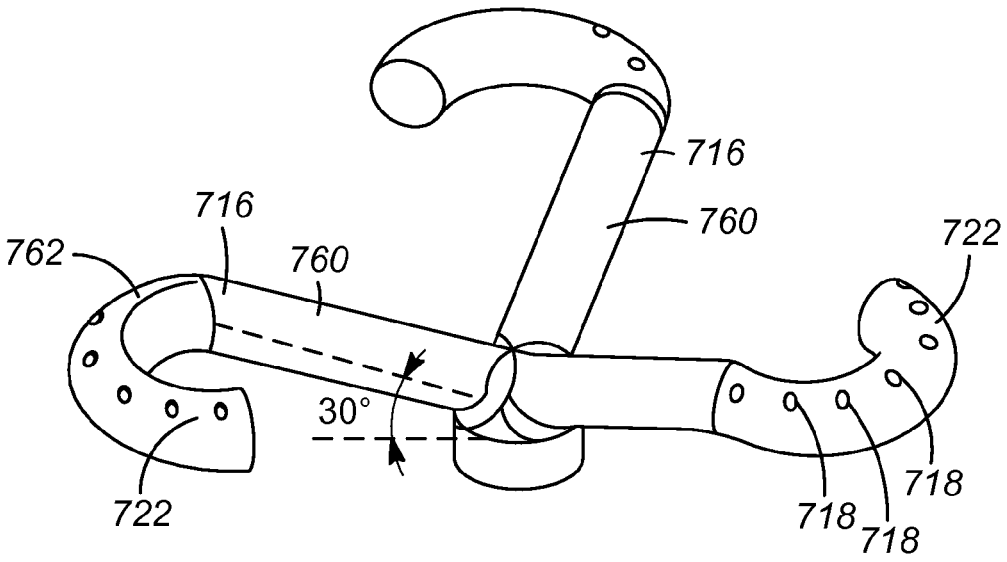
FIG. 8B shows a top and side perspective view of a portion of the flare burner shown in FIG. 8A; and, FIG. 8C shows a side cutaway view of a portion of the flare burner shown in FIG. 8A.
Figure 8C:
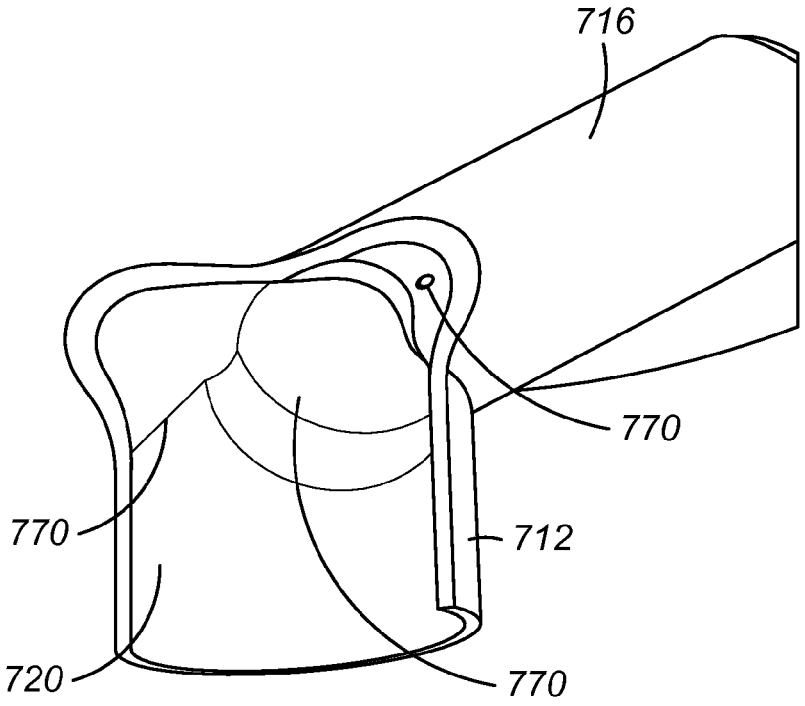

Turning to FIGS. 8A to 8C, another flare burner 710 according to the present invention is shown. As can been seen in this embodiment, each arm 716 of the burner 710 includes a portion 756 without any outlets 718 and a portion 758 with outlets 718. As depicted, the portion 756 without any outlets 718 comprises a linear portion 760 and the portion with outlets 758 comprises a curvilinear portion 762 (when viewed from the top of the flare burner 710). Other configurations are contemplated, for example, the portion 756 of the arm 716 without any outlets 718 may comprise a curvilinear portion, or the portion 758 of the arm 716 with outlets 718 may comprise a linear portion. As shown in FIG. 8B, the linear portion 760 of each arm 716 is preferably angled approximately 30 degrees up from a horizontal axis.

The outlets 718 on the arms 716 may be drilled prior to assembling the flare burner 710. Preferably, the outlets 718 are disposed on the upper surface 722 of the arm 716 approximately about a circumference of a circle.

Additionally, as can be seen in FIG. 8C, each arm 716 includes an inlet 770. Preferably, the inlets 770 for the arms 716 are disposed within the body 720 of the manifold 712 such that a portion of each inlet 770 intersects with an adjacent inlet 770. This will minimize the dead area inside of the body 720 of the manifold 712 in which combustion gases tend to accumulate instead of flowing out through the arms 716. This dead area has a tendency to create a hot spot on the top surface 726 of the body 720 of the manifold 712 (see, FIG. 8A) below the combustion zone where the combustion gases and oxygen are burning.

With reference to the flare burner 610 shown in FIGS. 7A to 7C and the flare burner 710 shown in FIGS. 8A to 8C, the configuration of the outlets will be described with the understanding that these may be applied to any of the embodiments described herein.

For example, if the outlets 618, 718 are disposed about a circumference of a circle, the outlets 618, 718 on each arm 616, 716 are preferably spaced at least 11 degrees from adjacent outlets 618, 718. See, FIGS. 7A and 8A. Furthermore, if the outlets 618, 718 on each arm 616, 716 are disposed about a circumference of a circle, it is contemplated that a distance $D_2$ between the manifold 612,712 and the outlet 618, 718 closest to the manifold 612, 712 on that arm 616, 716 may be greater than a radius $r_1$ of the circle. See, FIGS. 7A and 8A.

Additionally, a distance $D_2$ between the manifold 612, 712 and an outlet 618, 718 closest to the manifold 612, 712 on an arm 616, 716 is preferably greater than a distance $D_3$ between any two outlets 618, 718 on that arm 616, 716. See, FIGS. 7A and 8A.

It is also contemplated that, a plurality of outlets 618, 718 on an arm 616, 716 have a width $W_2$ defined as the distance between two furthest apart outlets 618, 718 on that arm 616. See, FIGS. 7A and 8A. Preferably, the width is smaller than a distance $D_4$ between the outlets 618, 718 on that arm 616, 716 and outlets 618, 718 on adjacent arm 616, 716. See, FIGS. 7A and 8A.

Some of the advantages of one or more flare burners shown herein is that it is cost effective, easy to build, modular, it is has small volume for shipping and storing by stacking. Additionally, the outlet configuration is customizable allowing for specific configurations which can be more efficient.

Any one of these flare burners according to the present invention is believed to provide for better gas flow to the flare burner so that sufficient oxygen in the surrounding atmosphere can mix with the gases exiting the flare burner. This improved mixing has significant direct and indirect benefits that address the problems associated with current designs. For example, by providing sufficient air and sufficient mixing in the lower portion of the flame close to the burner, the flame may be shorter and the combustion optimized.

A shorter flame will allow considerable cost savings, because the burner duty can be increased without increasing the height of the fence surrounding the flare system, as well as requiring less flare burners and, accordingly, less space for a flare system.

In sum, the various designs of the present invention provide for flare burners that address various shortcomings of the current designs. Any single design may alleviate one or more problem, and the various aspects and features of the designs may be combined to alleviate other problems.

It should be appreciated and understood by those of ordinary skill in the art that various other components were not shown in the drawings as it is believed that the specifics of same are well within the knowledge of those of ordinary skill in the art and a description of same is not necessary for practicing or understating the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A flare burner for burning combustible waste gases, the burner comprising:

a manifold comprising an inlet, a plurality of arms, and a plurality of outlets, the inlet configured to be secured to a conduit for combustible waste gases, and the plurality of outlets being disposed on a plurality of arms such that oxygen may mix with combustible waste gases exiting the outlets and wherein the manifold comprises a body, wherein the arms from the plurality of arms extend radially outward from the body, each arm having a first portion without apertures and a second portion having a curvilinear shape and having one or more apertures and wherein the first portion and the second portion have approximately the same length and further comprising:

the manifold comprising the body, wherein the arms from the plurality of arms extend radially outward from the body, wherein a first end of each arm is disposed adjacent the body of the manifold and a second end of each arm is split into two branched portions.

2. A flare burner for burning combustible waste gases, the burner comprising:

a manifold comprising an inlet, a plurality of arms, and a plurality of outlets, the inlet configured to be secured to a conduit for combustible waste gases, and the plurality of outlets being disposed on a plurality of arms such that oxygen may mix with combustible waste gases exiting the outlets, wherein the manifold comprises a body, wherein the arms from the plurality of arms extend radially outward from the body, each arm having a first portion without apertures and a second portion having a curvilinear shape and having one or more apertures and wherein the first portion and the second portion have approximately the same length wherein each arm includes a plurality of outlets, and the outlets on each arm are separated from adjacent outlets by a wall having a height between one to five times a diameter of the outlets and wherein the outlets of each arm are disposed on a portion of an arm has a cross-sectional shape comprising a top rounded portion and a tail portion comprising two intersecting linear edges.

* * * * *